US005945903A

United States Patent [19]

Reddy et al.

[11] Patent Number: 5,945,903

[45] Date of Patent: Aug. 31, 1999

[54] RESETTABLE AUTOMOTIVE CIRCUIT PROTECTION DEVICE WITH FEMALE TERMINALS AND PTC ELEMENT

[75] Inventors: Nagi Reddi Kanamatha Reddy, Schaumburg; Robert Swensen, Mount Prospect; Thomas F. Draho, Westchester; Michael Styrna, Gurnee, all of Ill.

[73] Assignee: Littelfuse, Inc., Des Plaines, Ill.

[21] Appl. No.: 08/919,243

[22] Filed: Aug. 30, 1997

Related U.S. Application Data

[63] Continuation-in-part of application No. 08/474,331, Jun. 7, 1995, Pat. No. 5,682,130, and application No. 08/480,124, Jun. 7, 1995, Pat. No. 5,663,861.

[51] Int. Cl.[6] ..... H01H 85/02; H01C 7/10; H01C 7/18

[52] U.S. Cl. ..... 337/197; 337/198; 337/216; 337/190; 338/22 R; 338/204

[58] Field of Search ..... 337/186, 190, 337/197, 198, 216; 338/22 R, 23, 20, 204, 205

[56] References Cited

U.S. PATENT DOCUMENTS

| | | | |
|---|---|---|---|
| 4,023,264 | 5/1977 | Schmidt, Jr. et al. . | |
| 4,331,861 | 5/1982 | Meixner . | |
| 4,549,161 | 10/1985 | McTavish et al. | 338/20 |
| 4,570,147 | 2/1986 | Ebi . | |
| 4,635,023 | 1/1987 | Oh . | |
| 4,672,352 | 6/1987 | Takano | 337/264 |
| 4,698,614 | 10/1987 | Welch et al. . | |
| 4,751,490 | 6/1988 | Hatagishi . | |
| 4,869,972 | 9/1989 | Hatagishi . | |
| 4,871,990 | 10/1989 | Ikeda et al. . | |
| 4,958,426 | 9/1990 | Endo et al. . | |
| 4,967,176 | 10/1990 | Horsma et al. . | |
| 5,142,265 | 8/1992 | Motoyoshi et al. . | |
| 5,153,555 | 10/1992 | Enomoto et al. . | |
| 5,233,326 | 8/1993 | Motoyoshi | 338/22 R |
| 5,294,906 | 3/1994 | Totsuka et al. . | |

FOREIGN PATENT DOCUMENTS

| | | |
|---|---|---|
| 0 242 902 A2 | 10/1987 | European Pat. Off. . |
| 0 259 179 A2 | 3/1988 | European Pat. Off. . |

*Primary Examiner*—Leo P. Picard
*Assistant Examiner*—Anatoly Vortman
*Attorney, Agent, or Firm*—Wallenstein & Wagner, Ltd.

[57] ABSTRACT

A circuit protection device including a pair of terminals to be electrically connected into an electrical circuit, a pair of spaced current-carrying extensions of the terminals, and an initially low resistance current limiting device extending between the current-carrying extensions. The invention includes the feature that the current-limiting element including flexible conductive current-feeding arms having inner and outer end portions, the inner end portions thereof being electrically connected to the current-carrying extensions of the terminals. The outer end portions of the current-feeding arms are cantilevered and flexible relative to the inner end portions. The device further preferably includes a PTC current-limiting element sandwiched between the flexible outer end portions of the current-feeding arms. The PTC element includes a layer of a PTC material having conductive opposite faces sandwiched between the flexible outer end portions of the arms so that the PTC material carries current between the outer end portions of the current-carrying arms. The layer of PTC material reaches a given trip level at an elevated current, expanding suddenly and substantially to flex the outer end portions of the current-carrying arm.

11 Claims, 4 Drawing Sheets

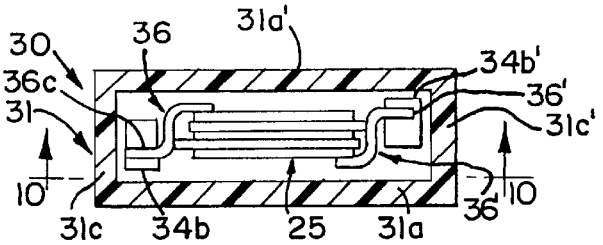
FIG. 11
FIG. 10
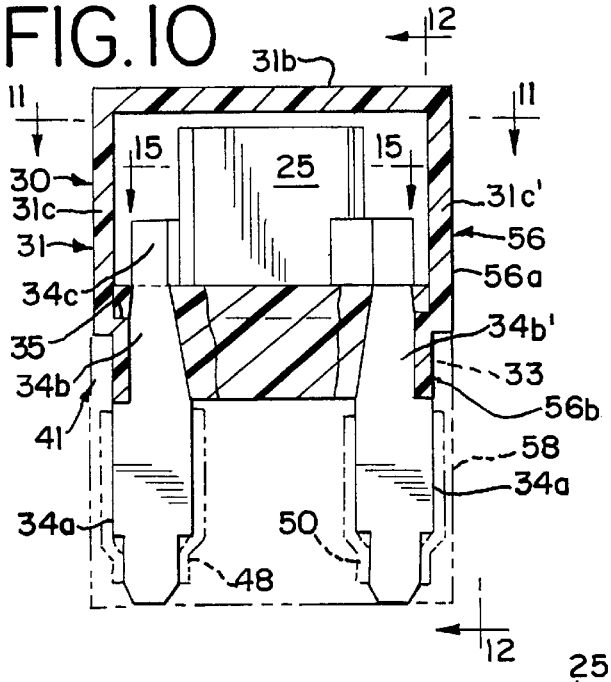
FIG. 12
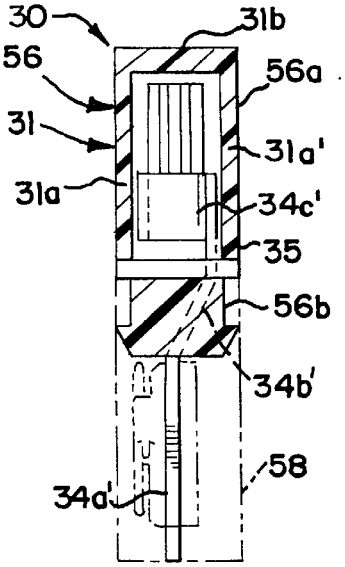
FIG. 13
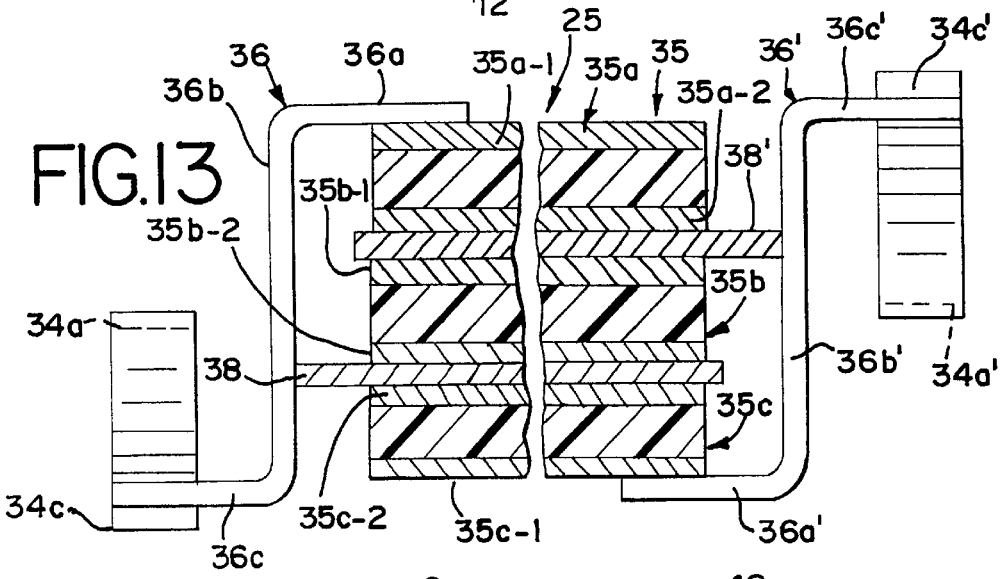
FIG. 14
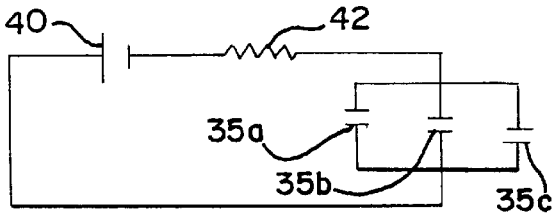

RESETTABLE AUTOMOTIVE CIRCUIT PROTECTION DEVICE WITH FEMALE TERMINALS AND PTC ELEMENT

RELATED APPLICATIONS

This application is a continuation-in-part of U.S. application Ser. Nos. 08/474,331, filed on Jun. 7, 1995, now U.S. Pat. No. 5,682,130, and 08/480,124, also filed on Jun. 7, 1995, now U.S. Pat. No. 5,663,861.

DESCRIPTION

TECHNICAL FIELD OF THE INVENTION

The present invention is a resettable circuit protection device. Particularly, the circuit protection device includes female-style terminals and one or more positive temperature coefficient (PTC) elements. The devices of the present invention are especially suited for automotive circuits. However, some aspects of the invention have a broader application.

BACKGROUND OF THE INVENTION

Fuses that are suited for use in automobiles and other circuit protection purposes may be found in both male- and female-type configurations. Many such fuses are two-piece assemblies.

One common configuration includes a box-like housing and an all metal male or female one-piece fuse element secured within that box-like housing. Some such prior female fuse assemblies have a metal female fuse element with a pair of spaced-apart female terminals which are accessible from one end of the housing. The female terminals are closely proximate to the housing walls.

An unsupported metallic fuse link is typically suspended between the extensions of the female terminals. The metallic fuse link is closely spaced from the housing side walls. A low fusing point metal is typically attached to the metallic fuse link.

The housing has slot-like openings at one of its ends, and the female terminals are accessible from these slot-like openings. Particularly, male blade-type terminals can be inserted through these slot-like openings to access the female terminals. These male blade-type conductors typically extend from a mounting panel or fuse block. Typical one-piece female fuse elements and the methods of making them are described in U.S. Pat. Nos. 4,344,060, 4,570,147, 4,751,490 and 4,958,426.

Automobile and other female fuse assemblies also have included an all metal female three-piece fuse element in place of a one-piece fuse element. As in the previously mentioned female fuses, the metal female fuse element has a pair of spaced-apart female terminals which are accessible from one end of the housing. The female terminals can be created from typical male terminals by adding female sockets to the male terminals, rather than forming the complete female fuse element from one piece. This structure and method of making such a fuse is described in U.S. Pat. Nos. 4,672,352 and 4,869,972.

There are several constraints which exist when working with a one-piece female fuse construction. For example, the stiffness or resilience (spring qualities), as well as the conductivity, of the fuse element material become important factors in determining the materials to be used. It is clear that the conductivity of the material is important, because of the principle that unnecessary resistance will increase the voltage drop of the fuse, thus reducing the amount of current flowing through the fuse. The resilience of the material is also important because the female engagement portion of the female fuse element must be durable and spring-like in order to continuously grip the male terminals on the terminal block in a snug manner. The resiliency is important in view of gravitational forces exerted on the fuse element when current heats up the fuse element, as described in U.S. Pat. No. 4,635,023.

When determining an appropriate construction for a three-piece fuse, the designer can choose materials for the fuse element which are different from the materials of the female sockets. Specifically, the designer may choose a material for the fuse element which will allow for suitable conductivity, while at the same time the designer can choose a different material for the female sockets which will provide ample resilience to effect a snug fit between the fuse element, sockets, and male terminals inserted in the female socket. A snug fit will keep the resistance, and thus the current loss, low between the terminals of the fuse element and male terminals connected or linked thereto by the sockets.

A snug fit only exists if there is practically no movement between the fuse element, sockets, and male terminals inserted in the sockets. These elements should also remain still, relative to their housing, to prevent the snug fit from being broken by any movement between these elements. If the fit between the fuse element, sockets and male terminals does not remain snug over time, the resistance will increase and become unsatisfactory for prolonged commercial use.

Although U.S. Pat. No. 4,869,972 to Hatagishi discloses a three-piece female fuse configuration, this patent does not disclose a configuration that lends itself to a prolonged snug fit. The female sockets from this patent are disclosed as being used for testing. It is believed, however, that if this configuration was placed in a commercial environment (i.e., onto a male fuse block within an automobile), small vibrations in the commercial environment would cause the fit between the fuse element, sockets and male terminals to move about and loosen. Without a snug fit, movement between these elements would cause a higher resistance within the fit, causing a loss of current as well as unwanted heating of the fuse connections near the fuse block.

U.S. Pat. No. 4,672,352 also discloses a three-piece fuse assembly which includes a fuse element, tab insertion sockets, and a housing to house the element and sockets. The focus of this patent is that the fuse element can be replaced without replacing the sockets or housing. Thus, construction of the housing allows for the fuse element to be removed without removing the sockets. This construction also appears to fail to provide firm fit of the sockets or fuse element within the housing, unless a male terminal is inserted in the sockets to force these elements outward from the male terminal. In addition, the fuse element is not secured to the socket in any way. The sockets are secured to the housing in a manner independent to the securement of the fuse element to the housing. If the fuse terminal moves within the housing, not only will the fuse element move in relation to the housing, but it will also move in relation to the sockets. Movement of the fuse element would also likely take place relative to the male terminal.

Resettable fuses that include a polymeric PTC material in lieu of a conventional, metallic fusible link are now available on the market. They are sold in various different configurations, none of which is like those of the present invention. Some of these prior art resettable circuit protection devices include a PTC element having a plate-like appearance and comprising a thin layer of a PTC material having a pair of thin coatings of metal forming terminals or electrodes on the opposite faces of the PTC layer. A pair of thin wire leads are electrically secured by solder to the opposite conductive faces of the PTC layer.

A variety of PTC elements like that just described are referred to as resettable fuses and are sold under the registered trademark POLYSWITCH® by the Raychem Corporation of Menlo Park, Calif. The maximum continuous, non-hazardous current of these POLYSWITCH® fuses that will not cause the PTC element at 20° C. to switch from its low to its high resistance state, referred to as the "holding current," presently spans the current range of about 0.9–9.0 amps. The range of trip currents, which is the minimum continuous current that will cause the POLYSWITCH® fuses to be switched or tripped to a high resistance circuit-protecting state at 20° C., varies from about 1.8 to 18 amps. This high resistance circuit-protecting state is maintained by a small, self-heating trickle current. The largest fault current which such devices can interrupt without being damaged varies from about 50–100 amps. The initial minimum resistance of these circuit protection devices varies from about 0.02 to 0.20 ohms.

Polymer PTC materials which are believed to be used in such devices are disclosed in U.S. Pat. Nos. 4,237,441 and 4,545,926. These types of PTC materials generally include a mixture of organic crystalline polymers in which are distributed conductive particles which may include carbon black. In such materials, as current flow therethrough progressively increases, the materials are progressively heated until the current reaches the trip current level. At this level, the resistance of the material suddenly increases to a substantially higher level due to the volume expansion of the material. This expansion separates the conductive particles by larger distances, providing a greatly increased resistance to current flow between the particles.

Other generally relevant U.S. patents which disclose resettable fuses that include a polymeric PTC material in lieu of a conventional, metallic fusible link include U.S. Pat. Nos. 4,331,861, issued to Meixner on May 25, 1982; U.S. Pat. No. 4,698,614, issued to Welch et al. on Oct. 6, 1987; U.S. Pat. No. 5,142,265, issued to Motoyoshi et al. on Aug. 25, 1992; U.S. Pat. No. 5,153,555, issued to Enomoto et al. on Oct. 6, 1992; and U.S. Pat. No. 5,233,326, issued to Motoyoshi on Aug. 3, 1993.

The configurations in which PTC resettable fuse devices have been commercially available are not suitable for automotive fuse applications. Thus, the present invention provides for a resettable, automotive circuit protection device which includes female terminals and one or more PTC elements.

SUMMARY OF THE INVENTION

The preferred forms of the present invention utilize plate-like PTC elements, such as those disclosed in pending application Ser. No. 08/437,966, filed on May 10, 1995, and also in U.S. Pat. Nos. 4,237,441, 4,545,926, 4,689,475 and 4,800,253. The disclosure of each of these references, and the references cited therein, is incorporated herein by reference. These elements may be used singly, or for the highest current ratings, in a uniquely arranged sandwich of such elements, mounted between flexible current-feeding arms. These arms are conductively connected to the extensions of coplanar plug-in terminal blades like that shown in U.S. Pat. No. 4,635,023. The flexible arms and the one or more PTC elements mounted between the flexible arms are sometimes referred to as the fuse link of the claimed circuit protection device.

In the preferred single PTC element embodiment of the invention, the flexible current-feeding arms are cantilevered and project in opposite directions from the spaced confronting margins of the current-carrying extensions of the terminal blades. To aid in the low cost, mass production of the circuit protection devices of the invention, both the terminal blades and their current-carrying extensions thereof, and the cantilevered, flexible, current-feeding arms, are preferably initially stamped from the same sheet of metal. In such case, the ends of the stamped current-feeding arms are initially coplanar, but spaced apart. The arms are then flexed to permit the insertion therebetween of the plate-like PTC element, with the opposite conductive faces of the PTC element resiliently sandwiched between the flexed, current-feeding arms. To assure a desired flexibility of the current-feeding arms, the arms can be stamped from a skived or thinned portion of sheet metal. The terminals and their current-carrying extensions, terminal blades and female style terminal extensions are stamped from the thicker portions of the sheet metal, so that they form rigid plug-in portions of the device.

In a less preferred form of the invention, the current-feeding arms can be separate flexible wires or the like, which are soldered or welded to the current-carrying extensions of the terminal blades. In this form of the invention, the ends of these current-carrying wires may be in different planes but confront in overlapped relation.

In both forms of the devices just described, if the layer of PTC material of the PTC element is of the type which must expand when it is heated by the trip current, the flexibility of the current-feeding arms is necessary to permit that expansion so that the conductive particles dispersed thereon can be further separated to provide the desired high resistance condition of the element in its tripped condition.

As previously indicated, another unique feature of the invention utilizes a sandwich or stack of a number of plate-like PTC elements, like those disclosed in pending application Ser. No. 08/437,966, filed on May 10, 1995, and also in U.S. Pat. Nos. 4,237,441, 4,545,926, 4,689,475 and 4,800,253. These PTC elements are electrically connected in parallel. This multiplies the current rating of the device by the number of elements so connected. Where there is a stack of three such PTC elements, one of the conductive faces of the central element and the inner conductive face of one of the outer elements are connected together and to the outer conductive face of the other outer element. The other conductive face of the central element and the inner conductive face of the latter element are connected together and to the outer conductive face of the first mentioned outer element. All these elements are identically oriented so that the conductive faces of the plate-like PTC elements are in parallel planes, thus, expansion of the elements under increased current flow is in the same direction. The outer conductive faces of the outermost elements are then sandwiched between flexible current-carrying arms. This forms a package of three PTC elements connected in parallel.

In accordance with another feature of this parallel embodiment of the invention, heat sinks, which may be copper plates, are respectively located between each of the inner conductive faces of the outer PTC elements and the adjacent conductive faces of the central element. They also form conductive paths which connect the PTC elements in parallel.

An essential feature of the present invention is that the PTC elements must be allowed to expand for the resettable circuit protection device to be effective. Such expansion is permitted.

The above and other features of the invention will become apparent by reference to the specification, claims, and drawings.

DESCRIPTION OF THE DRAWINGS

FIG. 10 is a vertical sectional view through another modified automotive circuit protection device of the invention with a two-piece insulating housing, confronting plug-in terminals, a pair of female-style terminal extensions, and three PTC elements;

FIG. 11 is a horizontal sectional view through FIG. 10 taken along section line 11—11 of FIG. 10;

FIG. 12 is a vertical sectional view through FIG. 10, taken along section line 12—12 of FIG. 10;

FIG. 13 is an enlarged horizontal sectional view through the metal portions of the circuit protection device shown in FIG. 10, taken along section line 15—15 of FIG. 10 and before the metal portions have been encapsulated in an insulating base;

FIG. 14 is an automotive circuit in which the device of FIGS. 10–13 is inserted.

DETAILED DESCRIPTION OF THE INVENTION

Figure 1:
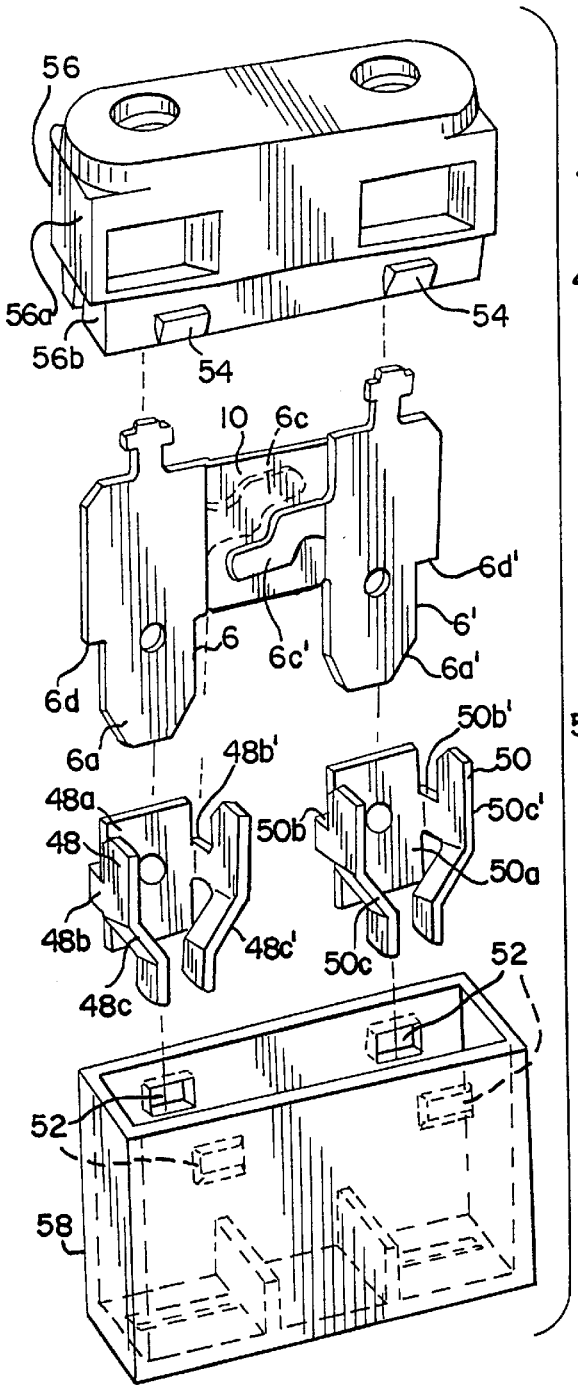
FIG. 1 is an exploded perspective view of a preferred resettable automotive circuit protection device of the invention with a two-piece insulating housing, confronting plug-in terminals, a pair of female-style terminal extensions, and a single PTC element.
Figure 2:
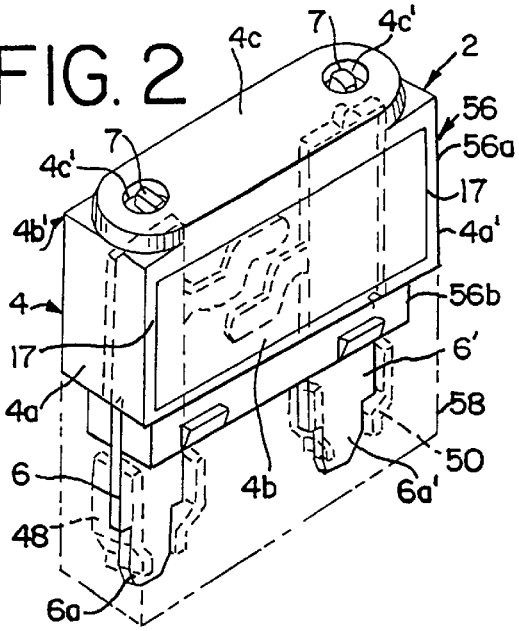
FIG. 2 is a perspective view of a preferred resettable automotive circuit protection device of the invention with a two-piece insulating housing, confronting plug-in terminals, a pair of female-style terminal extensions, and a single PTC element.

Exemplary Form of the Invention Shown in FIGS. 1–5

FIGS. 1–6 show the most preferred form of the circuit protection device 2 of the present invention, using a single PTC element 10. The device 2 is made initially of only five separate parts: an insulating housing 4; the PTC element 10; a pair of sheet metal pieces 6–6'; and, a pair of female-style terminal extensions 48 and 50. The insulating housing 4, includes an upper housing 56 and a lower housing 58. The upper housing 56 forms an upper support 56*a* and a male extension support 56*b*. The upper support 56*a* encapsulates the PTC element 10 and a pair of cantilever current-feeding arms 6*c*–6*c*'. The male extension support 56*b* integrally interacts with a top, open end portion 60 of the lower housing 58. For example, the male extension support 56*b* includes four tabs 54 which mate in a snapping fashion with four corresponding apertures 52 in the lower housing 58. Therefore, when the upper housing 56 and the lower housing 58 are interconnected, the four tabs 54 located on the male extension support 56*b* engage the four apertures 52 in the lower housing 58 to lock the upper housing 56 and the lower housing 58 together.

The pair of sheet metal pieces 6–6' respectively comprise a pair of spaced, parallel, rigid, confronting, coplanar terminal blades 6*a*–6*a*' and current-carrying extensions 6*b*–6*b*'. The pair of female-style terminal extensions 48 and 50 each comprise a vertical side wall 48*a* and 50*a* displaced between a pair of female extension arms 48*b*–48*b*' and 50*b*–50*b*', respectively. The female extension arms 48*b*–48*b*' and 50*b*–50*b*' connect the vertical side walls 48*a* and 50*a*, respectively, to a pair of female terminal blade supports 48*c*–48*c*' and 50*c*–50*c*'. The terminal blades 6*a*–6*a*' are shaped to cooperate with the female-style terminal extensions 48 and 50. Specifically, the terminal blades 6*a*–6*a*' include a shoulder portion 6*d*–6*d*' which cooperates with the female-style terminal extensions 48 and 50. The shoulder portions 6*d*–6*d*' on the terminal blades 6*a*–6*a*' rest on top of the female extension arms 48*b*–48*b*' and 50*b*–50*b*', respectively, and between the vertical sidewall 48*a* and 50*a* and the female terminal blade supports 48*c*–48*c*' and 50*c*–50*c*'.

Projecting from the confronting margins of the current-carrying extensions are thinner, flexible cantilever current-feeding arms 6*c*–6*c*'. The terminal blades 6*a*–6*a*', current-carrying extensions 6*b*–6*b*' thereof, and the cantilevered arms 6*c*–6*c*' were originally portions of a single strip 12 of sheet metal shown in FIG. 5. The strip unwinding from a roll (not shown) is moved to a series of processing stations. This includes metal stamping stations S1–S2, a station S3 at which the PTC element 10 is inserted between the confronting faces of the cantilevered arms 6*c*–6*c*' and is soldered thereto, and a station S4 which inserts the open-bottom housing 4 over the end of the strip before the end portion of the strip is severed to form an almost completely finished device 2. To increase the flexibility of the arms 6*c*–6*c*', the strip 12 is skived in the center thereof, to provide a thin region 12" between shoulders 12'—12' from which region the arms 6*c*–6*c*' are stamped. Since the arms 6*c*–6*c*' are fragile and spaced apart, the integrity of the strip is maintained by webs 11 of material extending between the terminal blades 6*a*–6*a*' of the various segments of the strip. Each web 11 is subsequently severed from the terminal blades 6*a*–6*a*'.

The PTC element 10 may be a thin plate-like element which comprises a central layer 10*b* (FIG. 4) on the opposite flat faces of which are applied thin layers or coatings of metal 10*a*–10*a*', forming electrodes for the PTC element 10. Preferably, the PTC elements and methods for manufacturing them disclosed in pending application, Ser. No. 08/437966, filed on May 10, 1995 are to be used in the present invention.

Specifically, central layer 10*b* may comprise 65% by volume high density polyethylene (manufactured by Quantum under the trade name Petrothene) and 35% by volume carbon black (manufactured by Cabot under the trade name BP 160-Beads). The composition which comprises central layer 10*b* may be produced by placing the high density polyethylene in a C.W. Brabender Plasti-Corder PL 2000 equipped with a Mixer-Measuring Head and fluxing it at 200° C. for approximately 5 minutes at 5 rpm. At this point the polyethylene is in a molten form. The carbon black is then slowly dispersed into the molten polyethylene over a 5 minute period at 200° C. at 5 rpm. The speed of the Brabender mixer is then increased to 80 rpm, and the polyethylene and carbon black are thoroughly mixed at 200° C. for 5 minutes. The energy input, due to the mixing, will cause the temperature of the composition to increase to 240° C.

After allowing the composition to cool, the composition is then placed into a C.W. Brabender Granu-Grinder where it is ground into small chips. The chips are then fed into the C.W. Brabender Plasti-Corder PL 2000 equipped with an Extruder Measuring Head. The extruder is fitted with a die having an opening of 0.002 inch, and the belt speed of the extruder is set at 2. The temperature of the extruder is set at 200° C., while the screw speed of the extruder is set for fifty 50 rpm. The chips are extruded into a sheet approximately 2.0 inches wide by 8.0 feet long. This sheet is then cut into a number of smaller sample PTC sheets (preferably 2.0 inch ×2.0 inch), and pre-pressed at 200° C. to a thickness of approximately 0.01 inch.

A polymer based thick film ink (CB115, manufactured by DuPont Electronic Materials) can then be applied to the top and bottom surfaces of the sample PTC sheets. The thin layers or coatings of metal which form electrodes 10*a*–10*a*' can include the silver-plated copper wire cloth (No. 9224T39, distributed by McMaster-Carr) disclosed in Example 1 in pending application, Ser. No. 08/437966, filed on May 10, 1995, or the nickel foam (available from Inco Specialty Powder Products) disclosed in Example 2 in pending application, Ser. No. 08/437966, filed on May 10, 1995. The electrode material is affixed to the top and bottom thick film ink coated surfaces of the sample PTC sheets.

If the metal electrodes 10*a*–10*a*' comprise the silver-plated copper wire cloth material, the sandwich structure (i.e., metal electrode 10*a*, central layer 10*b*, metal electrode 10*a*') is placed in a hot press for approximately four minutes at 400 p.s.i. and 230° C.

If the metal electrodes 10*a*–10*a*' comprise the nickel foam material, the sandwich structure (i.e., metal electrode 10*a*, central layer 10*b*, metal electrode 10*a*') is placed in a hot press having plates set at a temperature of 235° C. The temperature of the laminate is monitored until it reaches 220° C., at which point a pressure of 300 p.s.i. is applied to the laminate for 1 minute. The pressure in the press is then relieved. The laminate is then exposed to 625 p.s.i. for 5 minutes, while maintaining the plates of the press at 235° C.

In either embodiment, the laminated sheet is removed from the press and allowed to cool without further pressure. The laminated sheet is then sheared or punched into a plurality of PTC elements 10. The size of PTC element 10 will vary with the desired rating of the element. U.S. Pat. Nos. 4,545,926, 4,689,475, 4,237,441, and 4,800,253 also disclose PTC elements and methods for manufacturing PTC elements which may be used in the present invention.

When the PTC element 10 comprises a PTC layer 10*b* where the material includes a crystalline polymer in which is dispersed conductive particles, it is especially important that the cantilevered arms 6*c*–6*c*' be flexible relative to the relatively rigid, thicker portions of the terminal blades 6*a*–6*a*' and current-carrying extensions 6*b*–6*b*' thereof with which the arms are associated. When the temperature of the PTC layer 10*b* is raised to the trip point where the polymer material suddenly expands, the flexibility of the cantilevered arms 6*c*–6*c*' permits this expansion.

The upper support 36*a* of the upper housing 36 is preferably constructed as illustrated, where it has a pair of spaced confronting vertical side walls 4*b*–4*b*', a pair of vertical end walls 4*a*–4*a*' extending between the outer vertical margins of the side walls 4*b*–4*b*', and a top wall 4*c* having a pair of test probe-receiving holes 4*c*'–4*c*' (FIG. 1). The upper housing side walls 4*b*–4*b*' have relatively widely spaced central portions 4*b*-1 and 4*b*–1' (FIG. 3) which form a fairly substantial clearance space 19 within which the cantilevered arms 6*c*–6*c*' and the PTC element 10 are located. The size of the space 19 is such that the current-carrying arms 6*c*–6*c*' will be substantially spaced from these walls over the temperature range to which the PTC layer 10*b* of the PTC element is exposed. The outer margins of the side wall portions 4*b*-1 and 4*b*-1' merge with recessed wall portions 4*b*-2 and 4*b*-2' (FIG. 3) which are closely spaced to form interior narrow mounting slots or grooves 21–21' within which the current-carrying extensions 6*b*–6*b*' are closely confined. The upper ends of the current-carrying extensions 6*b*–6*b*' terminate in mounting tabs 7–7' which initially pass through narrow slots 9–9' formed in the top wall 4*c* of the upper housing at the bottom of the top wall test probes receiving holes 4*c*'–4*c*'. The tabs 7–7' are then twisted to anchor the terminal blade extensions 6*b*–6*b*' in place in the upper housing 4.

The end walls 4*a*–4*a*' of the upper housing 4 extend into inwardly offset grooves 13–13' so that the outer margins of the upper housing end walls 4*a*–4*a*' are aligned with the outer margins of the terminal blades 6*a*–6*a*'. Also, the side and upper margins of each upper housing side wall 4*b* and 4*b*' at 15 and 17—17 are in a common vertical plane so that the devices 2 can be stably stacked side-by-side when fed from magazines into sockets in fuse blocks by automatic fuse mounting devices. The upper housing end walls 4*a*–4*a*' are in vertical planes for the same reason, namely, so that they can be stacked stably in end-to-end relation in magazines for automatic feeding into fuse block sockets.

The terminal blades 6*a*–6*a*' may be plugged into the female-style terminal extension 48 and 50 to connect the PTC element 10 in series with a load resistance. This load resistance is 10 or more times greater than the resistance of the circuit protector device. When a normal current flows through that device, a modest amount of heat is generated in the PTC element layer 10*b* as a result of this low resistance. However, if the load resistance should be short circuited or become substantially reduced so that an undesired prolonged overload current flows through the PTC element 10, the current will reach a level known as the trip current of the PTC element 10. At this trip current level, the resistance of the PTC element 10 will suddenly increase by a large factor. The resulting higher resistance of the PTC element 10 now limits flow of current to a safe value. This limited current generated is nevertheless sufficient to keep the PTC layer

10*b* in a high resistance condition. If the load resistance should return a normal low value, either by replacement of the load itself or by removal of the condition which caused the high load, the current then flowing in the device 2 will be reduced below the trip level and the fuse is automatically reset to its original low resistance condition.

Figure 6:
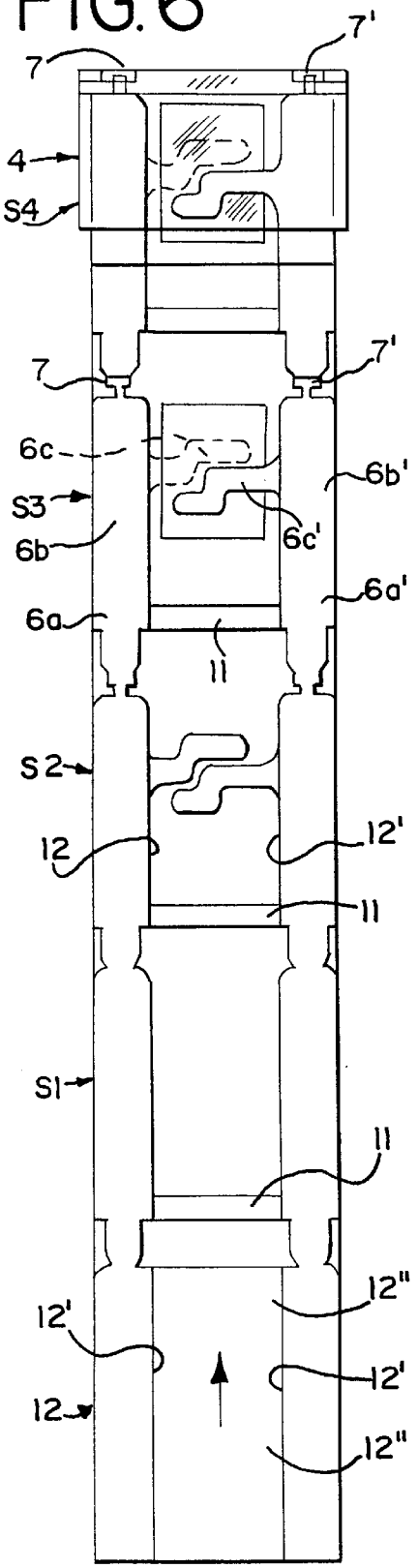
FIG. 6 illustrates the different steps in the manufacture of the fuse shown in FIG. 1.
Figure 7:
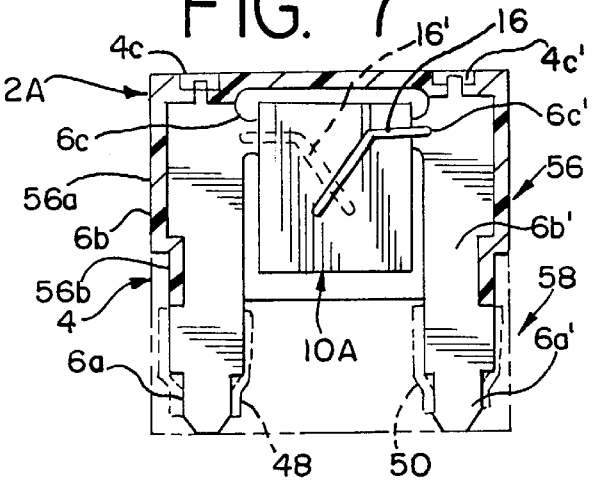
FIG. 7 is a vertical sectional view through a less preferred, single PTC-element automotive circuit protection device of the invention, with a two-piece insulating housing, confronting plug-in terminals, a pair of female-style terminal extensions, and a single PTC element.

Embodiments of FIGS. 6 and 7

Figure 8:
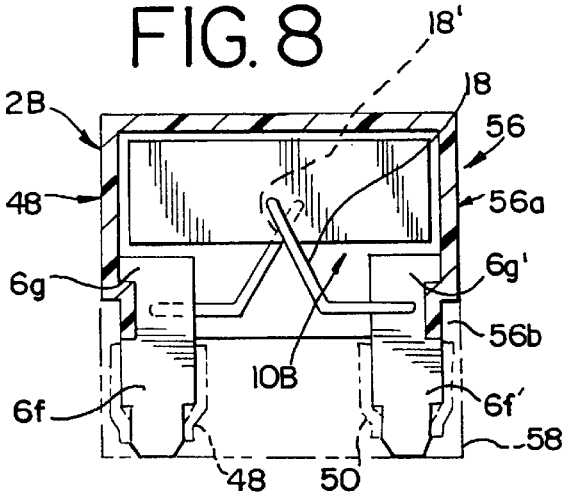
FIG. 8 is a vertical sectional view through a modified automotive circuit protection device of the invention with a two-piece insulating housing, confronting plug-in terminals, a pair of female-style terminal extensions, and a single PTC element.

FIGS. 7 and 8 show less preferred forms of the invention, which require an additional two separate pieces to form the upper housing of the assembled circuit protection device. The embodiment of FIG. 2 included cantilevered arms 6*c*–6*c*' which were formed as an integral part of the terminal blades 6*a*–6*a*' and terminal blade extensions 6*b*–6*b*'. In contrast, in the embodiments illustrated in FIGS. 7 and 8, cantilevered current-feeding arms are formed by separate conductive wire-like elements (a) 16–16' in the circuit protection device 2A of FIG. 7; and (b) 18–18' in the circuit protection device 2B of FIG. 8. The inner ends of these wire-like elements are soldered or otherwise connected to terminal tabs 6*c*–6*c*' projecting from the terminal blade extensions 6*d*–6*d*' of the device 2A in FIG. 7 and are soldered or otherwise connected to terminal blade extensions 6*g*–6*g*' of device 2B in FIG. 8. The other ends of these wire-like elements 16–16' and 18–18' are respectively soldered to the opposite conductive faces of the PTC element 10A of the device 2A in FIG. 7 and the PTC element 10B of the device 2B in FIG. 8.

The devices 2A and 2B also differ in that the device 2A has the identical housing 4 used by the device 2 shown in FIGS. 1–4. Such a housing 4 of device 2A includes test probereceiving openings 4*c*–4*c*' in which are exposed the twisted upper ends of the terminal blade extensions 6*b*–6*b*' of terminal blades 6*a*–6*a*'.

The housing 4B of device 2B of FIG. 8, however, does not have any test probe-receiving openings. Accordingly, its terminal blades 6*f*–6*f*' terminate in very short current-carrying extensions 6*g*–6*g*' leaving a much wider space above the terminal blade extensions for a horizontally elongated PTC element 10B, which extends almost the full width of the interior of the housing 4B.

In contrast, the PTC element 10A in the circuit protection device 2A shown in FIG. 7 is a vertically elongated element which fits within the space between the confronting margins of the terminal blade extensions 6*b*–6*b*'.

The configuration of the male extension support 4B', the lower housing 58, and the terminal blades 6*a*–6*a*' remain the same as those in FIGS. 1–6.

Figure 9:
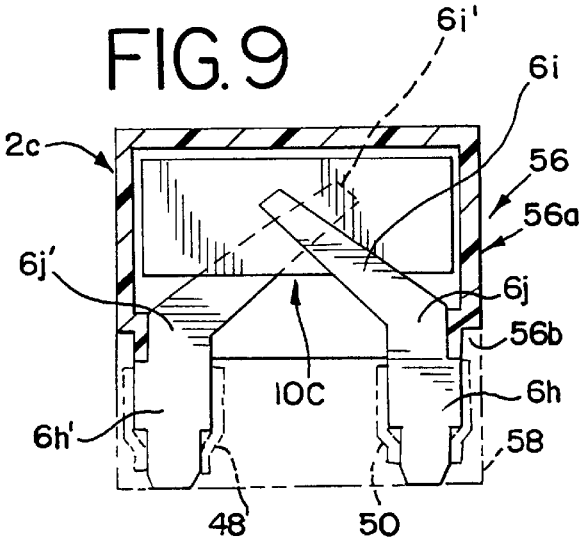
FIG. 9 is a vertical sectional view through a still further modified single PTC element automotive circuit protection device of the invention with a two-piece insulating housing, confronting plug-in terminals, a pair of female-style terminal extensions, and using one PTC element.

Embodiment of FIG. 9

FIG. 9 illustrates a modification of a circuit protection device wherein a pair of cantilevered arms 6*i*–6*i*' project and incline inwardly and upwardly from terminal blade extensions 6*j*–6*j*'. One sheet metal stamping is used to form an arm 6*i* or 6*i*', a terminal blade extension 6*j* or 6*j*', and a terminal blade 6*h* or 6*h*'. However, it should be noted that the distal ends of the cantilevered arms 6*i*–6*i*' are in spaced-apart, overlapping relation. Thus, both terminal blades and their current-carrying extensions in association with the cantilevered arms are made from separate stampings. The distal ends of the cantilever arms 6*i*–6*i*' are shown soldered and connected to the opposite conductive faces of a horizontally elongated PTC element 10C, which may be the same element 10B shown in the embodiment of FIG. 8. The circuit protection device 2C of FIG. 9 also is devoid of any test probe-receiving apertures, as in the previously described embodiments of FIG. 8. The embodiment shown in FIG. 9, circuit protection device 2C, will include the male extension support 2C', the lower housing 58, and the terminal blades 6*a*–6*a*' as shown in FIGS. 1–6.

Embodiment of FIGS. 10–14

The embodiment of the circuit protection device 30 shown in FIGS. 10–14 includes a sandwich 25 of three PTC elements 35*a*, 35*b* and 35*c* to greatly increase the current-carrying capacity of the devices previously described. The conductive faces of these PTC elements are confronting and parallel to each other, so that their expansion upon increases in temperature is cumulative. The device 30 shown in these figures is packaged in a manner similar to that shown in the embodiments of FIGS. 1–9, in that the terminal blades 34*a*–34*a*' thereof project in spaced confronting and coplanar relationship through the open bottom of an upper housing 31 which resembles the housing 4B used in the embodiment of the invention shown in FIG. 9. The terminal blades 34*a*–34*a*' join current-carrying extensions 34*b*–34*b*', the base portions of which angle in opposite directions and terminate in spaced, vertical terminal tabs 34*c*–34*c*' which are soldered or otherwise connected to the outer faces of terminal tab, attaching arms 36*c*–36*c*' of a pair of metal Z-shaped PTC element-mounting brackets 36–36'. The terminal tab attaching arms 36*c*–36*c*' of these brackets extend in spaced, parallel planes and respectively join the mid-sections 36*b*–36*b*' of the brackets 36–36' extending at right angles thereto. The mid-sections 36*b*–36*b*' of the Z-shaped brackets 36–36' terminate in the PTC element-attaching arms 36*a*–36*a*' which are respectively soldered or otherwise electrically connected to the outer conductive faces or terminals 35*a*-1–35*c*-1 of the outer PTC elements 35*a*–35*c*. The PTC element attaching arms 36*a*–36*a*' act as flexible arms cantilevered from the midsection 36*b*–36*b*' of the brackets 36*a*–36*a*'. The expansion of the PTC layer of the sandwich of PTC elements 35 will thus flex the arms 36–36'. Positioned between the outer PTC elements 35*a*–35*c* is a central PTC element 35*b*. The conductive faces or terminals 35*b*-1 and 35*b*-2 of the central PTC element 35*b* are respectively connected to the innermost conductive faces 35*a*-2 and 35*c*-2, respectively of the outer PTC elements 35*a* and 35*c* by copper heat sink plates 38 and 38' which respectively extend to and make electrical contact with the mid-section 36*b*–36*b*' of the brackets 36–36'. The PTC elements are thus effectively connected in parallel with each other.

The sandwich 25 of PTC elements 35*a*–35*c* and the Z-shaped brackets 36–36' are located in spaced relationship to a pair of main vertical spaced side walls 31*a*–31*a*' of an insulating upper housing 31 open at the bottom thereof. The top of the vertical side walls 31*a*–31*a*' join a horizontal top wall 31*b* and the side margins thereof join a pair of end walls 31*c*–31*c*'. The bottom of the housing end and side walls rest on and are secured to a ledge extending over the margins of a rectangular insulating base 41 made of a material molded around the tapered bottom portions of the extensions 34*b*–34*b*' of the terminal blades 34*a*–34*a*'.

Figure 3:
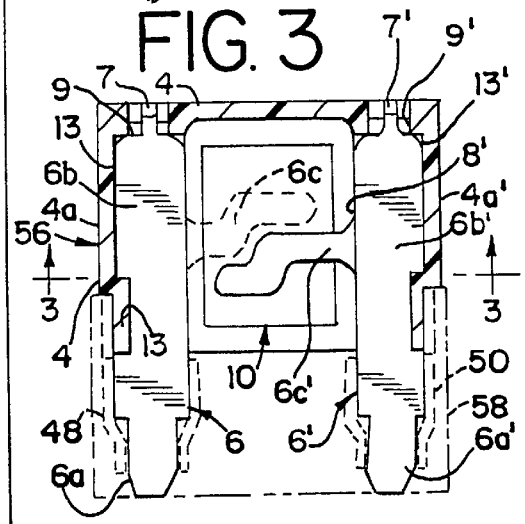
FIG. 3 is a vertical sectional view through the device of FIG. 2.
Figure 4:
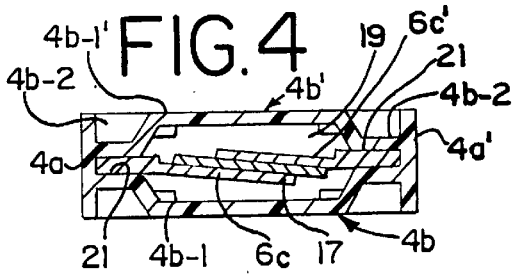
FIG. 4 is a horizontal sectional view through FIG. 3, taken along section line 3—3.
Figure 5:
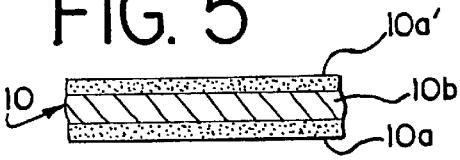
FIG. 5 is a fragmentary and greatly magnified sectional view through the plate-like PTC element of FIG. 1.

Assuming that the PTC elements 35*a*, 35*b* or 35*c* are each identical to the PTC element 10 shown in FIG. 3, the current rating of the circuit protection device 30 shown in FIGS. 10–13 is three times that of the circuit protection device shown in FIG. 1. This is because the load current will split evenly between the three PTC elements 35*a*, 35*b* and 35*c*.

One exemplary specification for the PTC element sandwich is as follows:

PTC Elements 35*a*, 35*b* and 35*c*—Disclosed in U.S. Pat. No. 4,800,253

Dimensions of each PTC Element:
Thickness=0.0115"
Length×Height=0.560"×0.500"

Copper Heat Sink Dimensions:
Thickness=0.022
Length×Height=0.630×0.500

Figure 16:
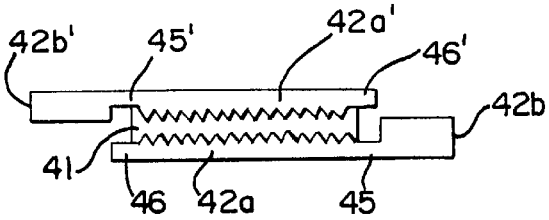
FIG. 16 is a horizontal sectional view of a portion of the automotive circuit protection device illustrated in FIG. 15.

FIG. 16 shows the PTC elements 35*a*, 35*b* and 35*c* connected in parallel with each other and in series with a car battery 40 and an electrical device or devices 42, illustrated diagrammatically as a load resistance. This device which operates in the same manner as that of FIGS. 1–6, except that the load current splits evenly into three paths.

Embodiments of FIGS. 15–18

Figure 15:
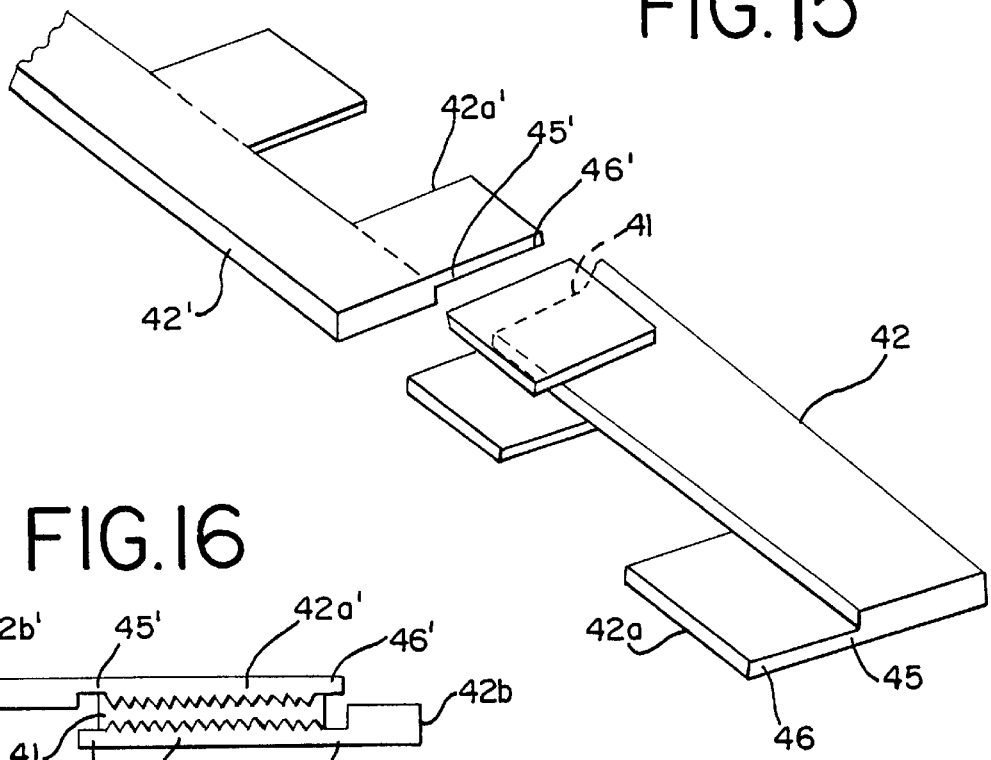
FIG. 15 is an exploded perspective fragmentary view of another embodiment of the automotive circuit protection devices of the present invention prior to their final assembly.
Figure 17:
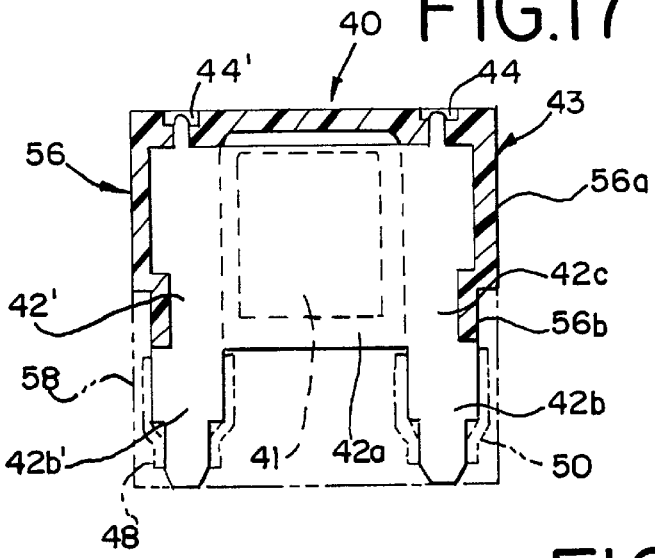
FIG. 17 is a vertical sectional view of a single automotive protection device illustrated in FIG. 16 with a two-piece insulating housing, confronting plug in terminals, and a pair of female style terminal extensions; and, FIG. 18 is an exploded fragmentary view of the interface between the plate-like PTC element and the electrode of the single automotive circuit protection device illustrated in FIG. 16.

The embodiment of the circuit protection device 40 illustrated in FIGS. 15–17 includes a single PTC element 41, and a pair of sheet metal pieces 42–42' (originally one piece) respectively forming a pair of spaced, parallel, rigid, confronting, coplanar terminal blades 42*b*–42*b*' and current-carrying extensions 42*c*–42*c*'. Projecting from the current-carrying extensions are skived, i.e., thinner, flexible cantilever electrodes 42*a*–42*a*'. The skived electrode portions 42*a*–42*a*', terminal blades 42*b*–42*b*', and current-carrying extensions 42*c*–42*c*' are formed from a continuous single strip of sheet metal.

As illustrated in FIGS. 15–18 skived electrodes 42*a*–42*a*' have inner end portions 45–45' and outer end portions 46–46'. The inner end portions 45–45' are electrically connected to the current carrying extensions 42*c*–42*c*' of the terminal blades 42*b*–42*b*'. The outer end portions 46–46' of skived electrodes 42*a*–42*a*' are cantilevered and flexible with respect to the inner end portions 45–45'.

Figure 18:
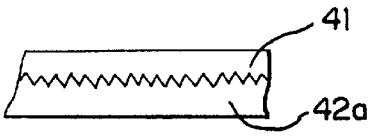

Referring specifically to FIGS. 16 and 18, PTC element 41 is similar to PTC element 10 in FIGS. 1–6, except that PTC element 41 does not include thin layers or coatings of metal 10*a*–10*a*'. Instead, PTC element 41 comprises a single plate-like element, preferably a polymer made conductive by dispersing conductive particles therein, as discussed in detail above. The inner surface of skived electrode portions 42*a*–42*a*' are micro-grooved to increase surface area and improve the electrical connection between PTC element 41 and skived electrode portions 42*a*–42*a*'.

PTC element 41 is sandwiched between and ultrasonically bonded to the outer end portions 46–46' of the flexible skived electrodes 42*a*–42*a*' so as to be in electrical contact with the outer end portions 46–46'. PTC element 41 conducts a given range of electrical currents presenting a relatively low resistance, however, when current flow therethrough reaches a given trip level the resistance thereof suddenly increases to a relatively high resistance value to limit current in the circuit it is being used to protect.

With reference now to FIG. 17, the sandwich structure illustrated in FIG. 16 has the identical housing 43 used by the device 2 shown in FIGS. 1–5. Such a housing 43 of device 40 includes test probe receiving openings 44–44' in which are exposed the upper ends of the terminal blade extensions 42*b*–42*b*'.

Embodiments of FIGS. 7–18

The embodiments of FIGS. 7–18 all include identical female-style terminal extensions 48 and 50 and insulating housings 4. Specifically, the pair of female-style terminal extensions 48 and 50 each comprise a vertical side wall 48*a* and 50*a* displaced between a pair of female extension arms 48*b*–48*b*' and 50*b*–50*b*', respectively. The female extension arms 48*b*–48*b*' and 50*b*–50*b*' connect the vertical side walls 48*a* and 50*a*, respectively, to a pair of female terminal blade supports 48*c*–48*c*' and 50*c*–50*c*'. The terminal blades 6*a*–6*a*' are shaped to cooperate with the female-style terminal extensions 48 and 50. For example, the terminal blades 6*a*–6*a*' include a shoulder portion 6*d*–6*d*' which cooperates with the female-style terminal extensions 48 and 50. The shoulder portions 6*d*–6*d*' on the terminal blades 6*a*–6*a*' rest on top of the female extension arms 48*b*–48*b*' and 50*b*–50*b*', respectively, and between the vertical sidewall 48*a* and 50*a* and the female terminal blade supports 48*c*–48*c*' and 50*c*–50*c*'.

Also, the insulating housing 4, includes an upper housing 56 and a lower housing 58. The upper housing 56 forms an upper support 56*a* and a male extension support 56*b*. The upper support 56*a* encapsulates the PTC element 10 and a pair of cantilever current-feeding arms 6*c*–6*c*'. The male extension support 56*b* integrally interacts with a top, open end portion 60 of the lower housing 58. For example, the male extension support 56*b* includes four tabs 54 which mate in a snapping fashion with four corresponding apertures 52 in the lower housing 58. Therefore, when the upper housing 56 and the lower housing 58 are interconnected, the four tabs 54 located on the male extension support 56*b* engage the four apertures 52 in the lower housing 58 to lock the upper housing 56 and the lower housing 58 together.

Interpretation of the Claims

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances, even the specific claims involved should be construed in light of the doctrine of equivalents.

We claim:

1. A circuit protection device to be connected into a circuit presenting a given load resistance, the circuit protection device comprising:

first and second terminals to be electrically connected into the electrical circuit, each terminal comprising a current carrying extension, a terminal blade and a female-style terminal extension;

flexible conductive current-feeding arms having inner and outer end portions, the inner end portions thereof being electrically connected respectively to the current-carrying extensions of the terminals, the outer end portions of said current-feeding arms being cantilevered and flexible with respect to the inner end portions thereof; and, a PTC current-limiting element positioned between the flexible outer end portions of the current-feeding arms, the PTC element including a layer of a PTC material having conductive opposite faces, the conductive opposite faces being in electrical contact with the flexible outer end portions of the current-feeding arms so that the PTC material carries current between the outer end portions of the current-carrying arms, the PTC material conducting a given range of currents presenting a given low resistance value and when current flow therethrough reaches a given trip level, the resistance thereof increases to a high resistance value to limit current in the circuit, wherein each of the current-feeding arms and the associated current-carrying extension and terminal blade thereof are cut from a single piece of metal.

2. The circuit protection device of claim 1, wherein both of said current-feeding arms and the associated current-carrying extensions and terminal blades thereof are cut from the same piece of metal.

3. The circuit protection device of claims 1 or 2, wherein the associated terminal blades and current-carrying extensions thereof are cut from a thick portion of the single plate of metal and the current-feeding arms are cut from a thin portion of the single plate of metal.

4. A circuit protection device to be connected into a circuit presenting a given load resistance, the circuit protection device comprising:

first and second terminals, each terminal comprising a current-carrying extension, a terminal blade, and a female-style terminal extension;

flexible current-feeding arms cantilevered and projecting in opposite directions from the current-carrying extensions of the terminals, respectively;

a PTC element electrically connected between the current-feeding arms so that the PTC element carries current flowing between the terminals, when a normal current passes between the terminals, the PTC element has a low resistance and, when heated by the passage of a higher trip current passing between the terminals, the PTC element will expand to flex the current-feeding arms, permitting the PTC element to have a large resistance and limit current flow in the circuit; and, a housing having an opening to allow access to the female-style terminal extensions.

5. The circuit protection device of claim 4, wherein the current-feeding arms are spaced from the housing a sufficient distance such that the current-feeding arms will not contact the housing during expansion of the PTC element.

6. The circuit protection device of claim 4, wherein the housing comprises a top portion and a bottom portion, the top portion having a plurality of tabs which mate with corresponding openings in the bottom portion to secure the top and bottom portions of the housing around the terminals, the current feeding arms and the PTC element.

7. A circuit protection device to be connected into a circuit presenting a given load resistance, the circuit protection device comprising:

first and second terminals, each terminal comprising a current-carrying extension, a terminal blade, and a female-style terminal extension;

flexible current-feeding arms having inner and outer end portions, the inner end portion of the current-feeding arms respectively being electrically connected to the current-carrying extensions;

a plurality of PTC elements positioned between the current-feeding arms, at least two of the PTC elements connected in parallel to one another; and, the first and second terminals, the flexible current-feeding arms and the plurality of PTC elements contained within a housing, and wherein there is located, between the plurality of PTC elements, a heat sink-forming body in electrical and thermal contact with one of the current-feeding arms.

8. The circuit protection device of claim 7, wherein when a normal current passes through the plurality of PTC elements, the PTC elements have a low resistance, and when a higher trip current which is to be limited by the circuit protection device flows through the plurality of PTC elements, the PTC elements expand causing the current-feeding arms to flex and the resistance of the PTC elements to increase to a high resistance, thus limiting current flow in the circuit in which the device is connected.

9. The circuit protection device of claim 7, wherein the plurality of PTC elements includes two outermost PTC elements and each of the current-feeding arms forms a substantially Z-shaped member, each Z-shaped member including an intermediate section and outer sections extending in opposite directions at opposite ends of the intermediate section, one of the outer sections of one of the Z-shaped members extending along and being electrically connected to one of the outermost PTC elements and one of the outer sections of the other Z-shaped member extending along and being electrically connected to the other outermost PTC element.

10. A circuit protection device to be connected into a circuit presenting a given load resistance, the circuit protection device comprising:

first and second terminals, each terminal comprising a current-carrying extension, a terminal blade, and a female-style terminal extension;

a pair of flexible skived electrodes having inner and outer end portions, the inner end portions thereof being electrically connected respectively to the current-carrying extensions of the terminals, the outer end portions of the flexible skived electrodes being cantilevered and flexible with respect to the inner end portions thereof; wherein the flexible skived electrodes have a microgrooved inner surface, and a PTC element sandwiched between and in electrical contact with the flexible skived electrodes so that the PTC element carries current between the flexible skived electrodes, the PTC element conducting a given range of currents presenting a given low resistance and when current flow therethrough reaches a given trip level the resistance thereof increases to a high resistance value to limit current in the circuit.

11. The circuit protection device of claim 10, wherein when current flow through the PTC element reaches a given trip level, the PTC element expands, causing the skived electrodes to flex.

* * * * *